US010157598B2

(12) United States Patent
Son

(10) Patent No.: US 10,157,598 B2
(45) Date of Patent: Dec. 18, 2018

(54) MOUTHPIECE CAP FOR A MUSICAL INSTRUMENT

(71) Applicant: Leto R&D Corporation, Hackensack, NJ (US)

(72) Inventor: Hye Seong Son, Closter, NJ (US)

(73) Assignee: LETO R&D CORPORATION, Hackensack, NJ (US)

( * ) Notice: Subject to any disclaimer, the term of this patent is extended or adjusted under 35 U.S.C. 154(b) by 20 days.

(21) Appl. No.: 15/599,955

(22) Filed: May 19, 2017

(65) Prior Publication Data

US 2017/0337908 A1 Nov. 23, 2017

Related U.S. Application Data

(60) Provisional application No. 62/338,933, filed on May 19, 2016.

(51) Int. Cl.
*G10D 9/02* (2006.01)

(52) U.S. Cl.
CPC ..... *G10D 9/02* (2013.01)

(58) Field of Classification Search
CPC ..... G10D 9/02
USPC ..... 84/453
See application file for complete search history.

(56) References Cited

U.S. PATENT DOCUMENTS 1,495,322 A * 5/1924 Greene ..... G10D 9/02 84/383 R
D135,886 S * 6/1943 Brilhart ..... D17/13
D156,847 S * 1/1950 Runyon ..... D17/13
2,600,853 A * 6/1952 Crescenzi ..... G10D 9/02 84/383 R
2,837,003 A * 6/1958 Collis ..... G10D 9/02 24/279
3,057,243 A * 10/1962 Jaquith ..... G10D 9/02 84/383 R
3,222,974 A * 12/1965 Amon ..... G10D 9/02 84/383 R
3,257,888 A * 6/1966 Krechmer ..... G10D 9/02 84/383 R
4,207,703 A * 6/1980 Saso ..... A01M 31/004 446/205
4,250,995 A * 2/1981 Lorenzini ..... G10D 9/023 206/314
4,821,670 A * 4/1989 Foxcroft ..... G10K 5/00 116/137 R
4,991,483 A * 2/1991 Petit ..... G10D 9/02 84/383 R
D343,633 S * 1/1994 Guardala ..... D17/13
5,303,628 A * 4/1994 Salazar ..... G10D 9/023 84/383 R (Continued)

FOREIGN PATENT DOCUMENTS

DE 3404795 A1 * 8/1985 ..... G10D 9/02
DE 19945818 A1 * 4/2001 ..... G10D 9/02

*Primary Examiner* — David Warren
*Assistant Examiner* — Christina Schreiber
(74) *Attorney, Agent, or Firm* — Kim Winston LLP

(57) ABSTRACT

A mouthpiece cap for a wind instrument including a body defining a cavity substantially complementarily shaped to a mouthpiece for a wind instrument. The body includes a top portion, a bottom portion that extends further than the top portion, and a plenum about a front end of the body. The mouthpiece cap further including a reed support positioned about a bottom portion of the body.

19 Claims, 5 Drawing Sheets

(56) References Cited

U.S. PATENT DOCUMENTS 5,398,582 A * 3/1995 Smith ..... G10D 9/02 84/383 R
6,570,077 B1 * 5/2003 Goss ..... G09B 15/06 84/383 R
D475,735 S * 6/2003 Louis ..... D17/99
8,217,248 B1 * 7/2012 Feliciano ..... G10D 9/02 84/380 R
8,512,294 B2 8/2013 Ou-Yang et al.
9,153,215 B2 * 10/2015 Morrison ..... G10D 9/023
D747,404 S * 1/2016 Selmer ..... D17/13
D771,237 S * 11/2016 Smutney ..... D24/110
D793,469 S * 8/2017 Son ..... D17/13
2005/0045022 A1 * 3/2005 Gillis ..... G10D 7/063 84/380 B
2006/0071040 A1 * 4/2006 Young ..... B65D 47/0838 222/484
2006/0283444 A1 * 12/2006 Jones ..... A61M 15/009 128/200.23
2007/0044636 A1 * 3/2007 Wanne ..... G10D 9/02 84/385 R
2007/0175314 A1 * 8/2007 Wanne ..... G10D 9/02 84/383 R
2007/0221039 A1 * 9/2007 Quaile, Sr. ..... G10D 9/00 84/383 R
2008/0022839 A1 * 1/2008 Sullivan ..... G10D 9/02 84/383 R
2009/0126552 A1 * 5/2009 Ferrando ..... G10D 7/005 84/383 A
2009/0217799 A1 * 9/2009 Rovner ..... G10D 9/02 84/383 R
2011/0185878 A1 * 8/2011 Nelson ..... G10D 9/02 84/363
2011/0259323 A1 * 10/2011 Crosby ..... A61M 15/009 128/200.14
2016/0140937 A1 * 5/2016 Wassermann ..... G10D 9/02 84/383 A
2016/0171958 A1 * 6/2016 Rovner ..... G10D 7/08 84/383 A
2016/0343358 A1 * 11/2016 Rovner ..... G10D 9/026

* cited by examiner

MOUTHPIECE CAP FOR A MUSICAL INSTRUMENT

BRIEF SUMMARY OF THE INVENTION

In accordance with a preferred embodiment, the present invention provides a mouthpiece cap for a wind instrument that includes a body and a reed support. The body is configured to define a cavity substantially complementary in shape to a mouthpiece for a wind instrument. The body includes a top portion, a bottom portion that extends further than the top portion, and a plenum about a front end of the body. The reed support is positioned about a bottom portion of the body.

The body comprises an elastomer. The bottom portion has a length sufficient to completely cover a rail of the mouthpiece. The mouthpiece cap further comprises a logo holder positioned about a top portion of the body.

The plenum is sized to be larger than a tip end of the mouthpiece. The reed support is unitarily formed with the body. The body include a plurality of apertures. Preferably, the plurality of apertures is in fluid communication with the plenum.

In accordance with another aspect, the present invention provides a wind instrument mouthpiece assembly comprising a mouthpiece for a wind instrument and a mouthpiece cap. The mouthpiece cap includes a body and a reed support positioned about a bottom portion of the body. The body is configured to define a cavity substantially complementary in shape to a distal end of the mouthpiece. The body includes a top portion, a bottom portion that extends further than the top portion, and a plenum about a front end of the body.

The body comprises an elastomer. The bottom portion has a length sufficient to completely cover a rail of the mouthpiece. The wind instrument mouthpiece assembly further comprises a logo holder positioned about a top portion of the body. The plenum is sized such that the surfaces of the plenum are spaced from the tip end of the mouthpiece when assembled together. The reed support is unitarily formed with the body. The body includes a plurality of apertures. The plurality of apertures is in fluid communication with the plenum. The body is sized to compressingly engage the mouthpiece when assembled together.

In a mouthpiece cap for a wind instrument embodying the principles of the present invention, the mouthpiece cap is made of elastic material able to firmly hold the mouthpiece at any angle. The mouthpiece cap includes an angled upper cover shaped to fit the contour of the mouthpiece for a more exact fit. A reed support provided by the mouthpiece cap guides the reed or the rail of the mouthpiece when being inserted into the cap, and prevents the reed from coming in contact with the inside of the cap.

The mouthpiece cap also includes a logo place holder for interchanging the logo and material. The mouthpiece cap further includes an extended bottom lip to cover entire length of the rail of the mouthpiece and also to prevent the reed from drying out. Furthermore, the mouthpiece cap includes a reed chamber at its tip. The reed chamber prevents the tip of reed and mouthpiece from touching the inside of the cap. Lastly, the mouthpiece cap includes holes at the front end of the cap for air circulation to avoid possible fungus accumulation.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
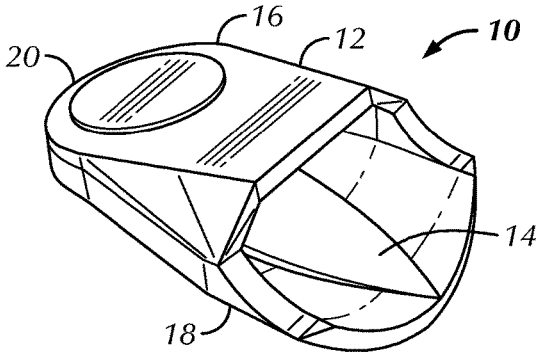
FIG. 1 is a rear perspective view of a mouthpiece cap for a musical instrument in accordance with a preferred embodiment of the present invention.

Reference will now be made in detail to the present embodiments of the invention illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as top, bottom, above, below and diagonal, are used with respect to the accompanying drawings. The term "distal" shall mean towards the bit-end. The term "proximal" shall mean towards the backhead-end. Such directional terms used in conjunction with the following description of the drawings should not be construed to limit the scope of the invention in any manner not explicitly set forth.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the identified element and designated parts thereof. Additionally, the term "a," as used in the specification, means "at least one." The terminology includes the words noted above, derivatives thereof and words of similar import.

Certain terminology is used in the following description for convenience only and is not limiting. The words "right," "left," "upper," and "lower" designate directions in the drawings to which reference is made. The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, and ±0.1% from the specified value, as such variations are appropriate.

Ranges: throughout this disclosure, various aspects of the invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the embodiments of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Referring to FIGS. 1-12, in accordance with a preferred embodiment, the present invention provides a wind instrument mouthpiece assembly 100 that includes a mouthpiece 102 and a mouthpiece cap 10.

The mouthpiece cap 10 is best shown in FIGS. 1-10. The mouthpiece cap 10 includes a body 12 and a reed support 14.

Figure 2:
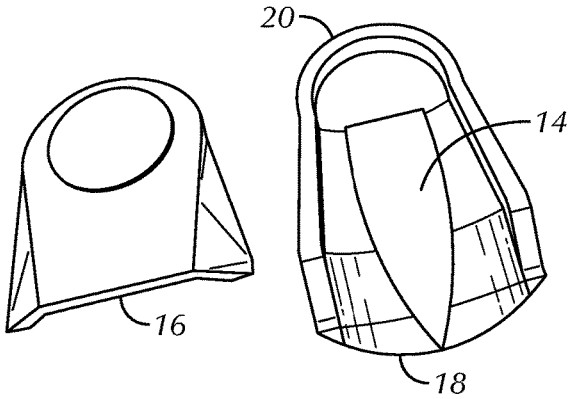
FIG. 2 is an exploded perspective view of the mouthpiece cap of FIG. 1.
Figure 3:
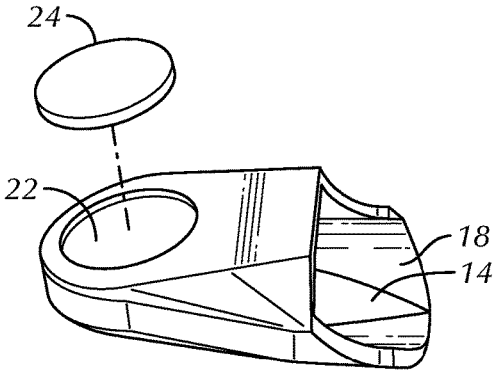
FIG. 3 is another exploded perspective view of the mouthpiece cap of FIG. 1.

The mouthpiece cap is configured as shown e.g., in FIG. 1, and includes a top portion 16, a bottom portion 18, and a plenum 20. FIG. 2 illustrates the top portion 16 separated from the bottom portion 18. Preferably the mouthpiece cap is formed with the top and bottom portions unitarily constructed. However, the top and bottom portions can alternatively be configured as separate components that are assembled together.

Preferably, the body of the mouthpiece is formed from an elastomer. Elastomers applicable to the present embodiment include, but are not limited to, saturated and unsaturated rubbers, and thermoplastic elastomers, for example, natural polyisoprene, synthetic polyisoprene, polybutadiene, chloroprene rubber, polychloroprene, neoprene, baypren, butyl rubber, styrene-butadiene rubber, nitrile rubber, ethylene propylene rubber, ethylene propylene diene rubber, epichlorohydrin rubber, polyacrylic rubber, silicone rubber, fluorosilicone rubber, fluoroelastomers, perfluoroelastomers, chlorosulfonated polyethylene, and ethylene-vinyl acetate.

Figure 13:
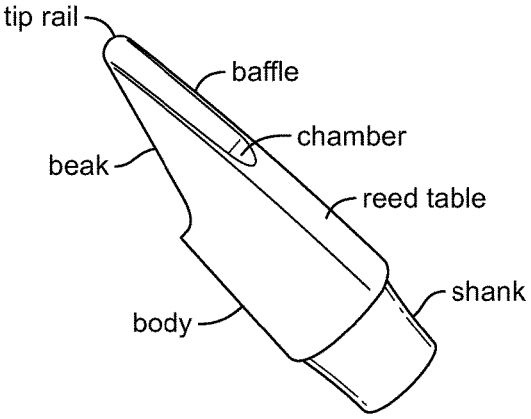
FIG. 13 (Prior Art)
FIG. 13 is a perspective view of a conventional wind instrument mouthpiece without a reed.

Referring back to FIG. 1, the bottom portion 18 is configured to extend further from a front end of the mouthpiece cap then the top portion 16. Specifically, the bottom portion is configured to have a length sufficient to completely cover a rail of a wind instrument mouthpiece. FIG. 13 illustrates various components of a conventional wind instrument mouthpiece.

The reed support 14 is configured as best shown in FIGS. 1 and 2. The reed support extends along the entire length of the bottom portion 18, but does not extend into the plenum 20. The reed support 14 guides a reed or a rail of the wind instrument mouthpiece when the mouthpiece is inserted into the mouthpiece cap. Further, the reed support member prevents the reed from substantial contact with an inside surface of the mouthpiece cap when the mouthpiece is assembled with the cap.

Preferably, the reed support 14 is integrally formed with the mouthpiece cap so as to define a unitary structure. That is, the reed support 14 is unitarily formed with the body 12 of the mouthpiece cap, and positioned about a longitudinal centerline of the bottom portion. Moreover, the reed support includes a tapered rear end adjacent the opening of the cap and terminates at a aperture.

The top portion 16 includes a recess or counterbore 22 for receiving a plate 24. Preferably, the recess or counterbore 22 is a circular counterbore, but can alternatively be any other shape suitable for receiving a correspondingly shaped plate, such as an oval, a triangle, a rectangle, an octagon, and the like. The plate 24 is preferably a logo plate that includes a logo and is correspondingly shaped to fit within the recess or counterbore 22. In other words, the mouthpiece cap includes a logo holder positioned about the top portion of the body.

The top portion is also configured to have a sloped inner surface. Specifically, the top portion surface slopes towards the bottom portion as it moves from the open end to the front end of the body. The sloped or angled top portion allows the mouthpiece cap to provide for a contoured and compressive fit on the mouthpiece.

The plenum 20 is positioned about a front end of the mouthpiece cap, and defines a space for receiving the tip of the mouthpiece of a wind instrument. As shown in FIGS. 1 and 2, the plenum is substantially circular in shape, but can alternatively be configured as any other shape suitable for its intended purpose, for example, oval, octagon, a square, a tangle, and the like. The plenum 20 is sized to be larger than the tip end of the mouthpiece to prevent the tip of the reed and mouthpiece from contacting the inside surfaces of the mouthpiece. In other words, the plenum is positioned about a front end of the body and sized such that the surfaces of the plenum are spaced from the tip end of the mouthpiece.

Figure 4:
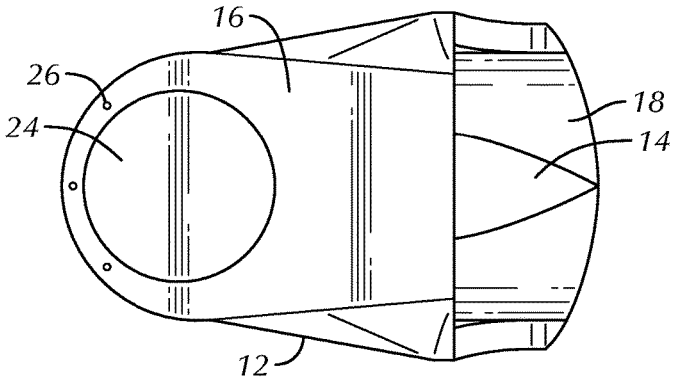
FIG. 4 is a top plan view of the mouthpiece cap of FIG. 1.
Figure 5:
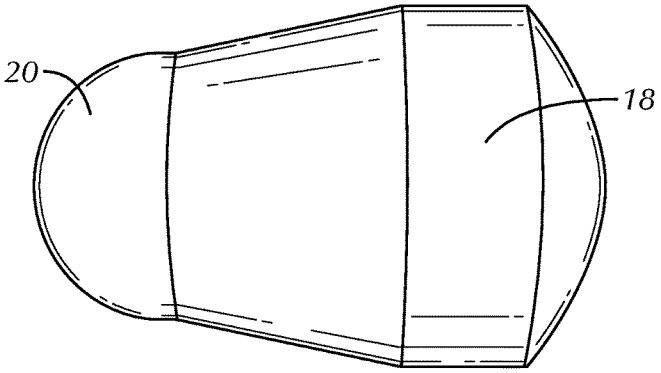
FIG. 5 is a bottom plan view of the mouthpiece cap of FIG. 1.
Figure 6:
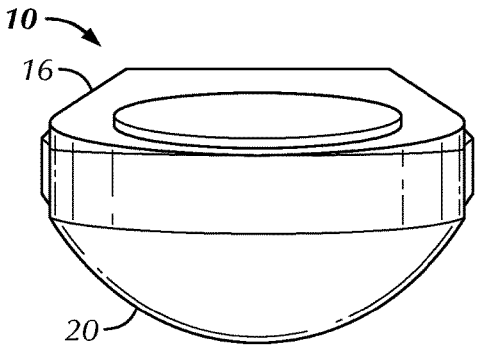
FIG. 6 is a front view of the mouthpiece cap of FIG. 1.
Figure 7:
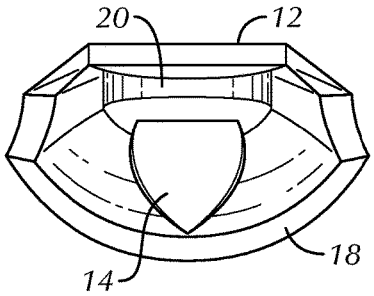
FIG. 7 is a rear view of the mouthpiece cap of FIG. 1.
Figure 8:
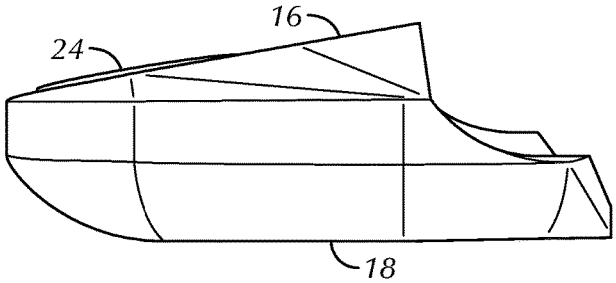
FIG. 8 is a side view of the mouthpiece cap of FIG. 1.
Figure 9:
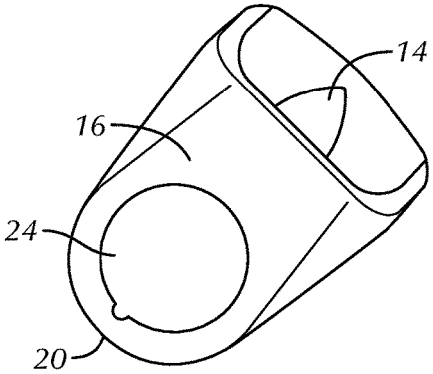
FIG. 9 is another perspective view of the mouthpiece cap in accordance with a preferred embodiment of the present invention.
Figure 10:
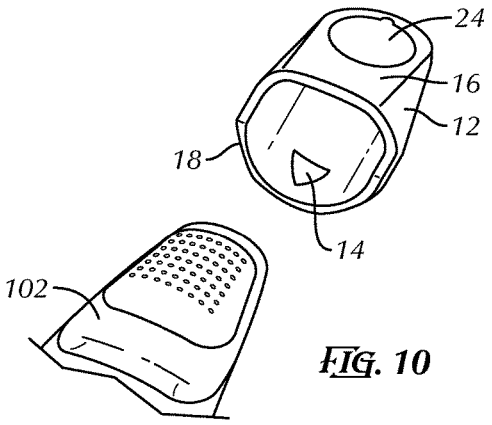
FIG. 10 is a perspective view of the mouthpiece cap of FIG. 9 adjacent a mouthpiece of a wind instrument.
Figure 12:
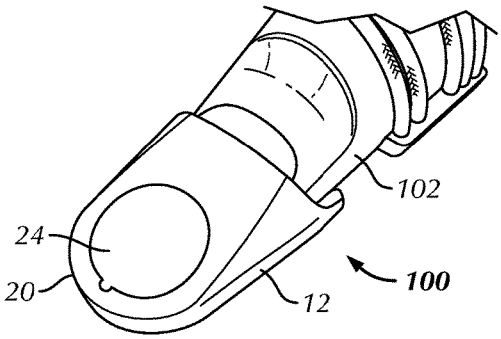
FIG. 12 is an enlarged partial front perspective view of the mouthpiece cap of FIG. 9 assembled to a wind instrument mouthpiece.

The body 12 also includes a plurality of apertures 26. Specifically, the plurality of apertures 26 are positioned about the front end of the body so as to be in fluid communication with the plenum 20. This allows for free air circulation within the plenum so as to avoid potential biological growth within the cap. The plurality of apertures 26 can be formed about the top portion, as shown in FIG. 4, or alternatively about a distal face portion of the body, or about the bottom portion of the body.

The mouthpiece cap 10 can optionally include one or more antibacterial agents or additives to resist or inhibit the growth of mold, fungi and bacteria. Such antibacterial agents can include e.g., Zinc OMADINE™ by Lonza, silver, and Iodine. Additional antibacterial agents applicable to the present invention are disclosed in U.S. Pat. No. 8,512,294, the entire disclosure of which is hereby incorporated by reference herein in its entirety for all purposes.

Figure 11:
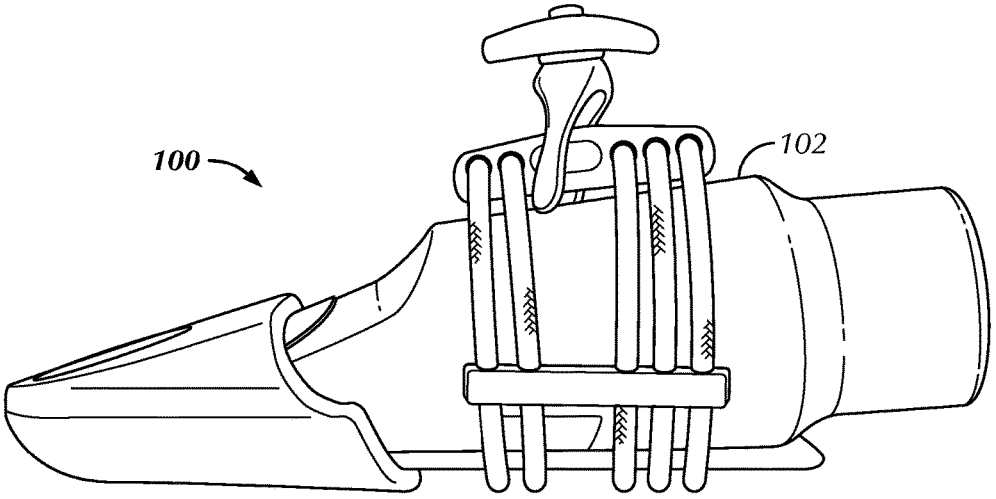
FIG. 11 is a side view of the mouthpiece cap of FIG. 9 assembled to a wind instrument mouthpiece.

The body 12 is also sized and configured to compressingly engage the mouthpiece when assembled together as shown in FIG. 11.

Owing to the elastomeric body of the mouthpiece cap, it advantageously provides sufficient stiction and/or contact adhesive forces to allow the mouthpiece cap to releasably and securely engage the mouthpiece.

It will be appreciated by those skilled in the art that changes could be made to the embodiments described above without departing from the broad inventive concept thereof. For example, additional components can be added to the mouthpiece cap. It is to be understood, therefore, that this invention is not limited to the particular embodiment disclosed, but it is intended to cover modifications within the spirit and scope of the present invention as described above.

I claim:

1. A mouthpiece cap for a wind instrument comprising:

a body defining a cavity substantially complementarily shaped to a mouthpiece for a wind instrument, wherein the body includes:

a top portion, a bottom portion that extends further than the top portion, a plenum about a front end of the body, and a plurality of apertures located on the top portion and opening into the plenum; and a reed support positioned about the bottom portion of the body.

2. The mouthpiece cap of claim 1, wherein the body comprises an elastomer.

3. The mouthpiece cap of claim 1, wherein the bottom portion has a length sufficient to completely cover a rail of the mouthpiece.

4. The mouthpiece cap of claim 1, further comprising a logo holder positioned about a top portion of the body.

5. The mouthpiece cap of claim 1, wherein the plenum is sized to be larger than a tip end of the mouthpiece.

6. The mouthpiece cap of claim 1, wherein the reed support is unitarily formed with the body.

7. The mouthpiece cap of claim 1, wherein the plenum is defined by a space adjacent to the front end of the body and in fluid communication with the cavity.

8. The mouthpiece cap of claim 7, wherein the reed support terminates at the space defining the plenum.

9. A wind instrument mouthpiece assembly comprising:

a mouthpiece for a wind instrument; and a mouthpiece cap that includes:

a body defining a cavity substantially complementarily shaped to a distal end of the mouthpiece, wherein the body includes:

a top portion, a bottom portion that extends further than the top portion, a plenum about a front end of the body, and a plurality of apertures located on the top portion and opening into the plenum, and a reed support positioned about the bottom portion of the body.

10. The wind instrument mouthpiece assembly of claim 9, wherein the body comprises an elastomer.

11. The wind instrument mouthpiece assembly of claim 9, wherein the bottom portion has a length sufficient to cover a rail of the mouthpiece.

12. The wind instrument mouthpiece assembly of claim 9, further comprising a logo holder positioned about a top portion of the body.

13. The wind instrument mouthpiece assembly of claim 9, wherein the reed support is unitarily formed with the body.

14. The wind instrument mouthpiece assembly of claim 9, wherein body is sized to compressingly engage the mouthpiece when assembled together.

15. The wind instrument mouthpiece assembly of claim 9, wherein the plenum is defined by a space adjacent to the front end of the body for receiving a tip end of the mouthpiece, and wherein the space and the cavity are in fluid communication.

16. The wind instrument mouthpiece assembly of claim 15, wherein the plenum is sized such that surfaces forming the space of the plenum are spaced from the tip end of the mouthpiece when assembled together.

17. The wind instrument mouthpiece assembly of claim 15, wherein the reed support terminates at the space defining the plenum.

18. A mouthpiece cap for a wind instrument comprising:

a body defining a cavity substantially complementarily shaped to a mouthpiece for a wind instrument, wherein the body includes:

a top portion, a bottom portion that extends further than the top portion, and a plenum defined by a space adjacent to a front end of the body; and a reed support positioned about the bottom portion of the body and not extending into the plenum, wherein the plenum and the cavity are in fluid communication.

19. The mouthpiece cap of claim 18, wherein the cavity is sized to compressingly receive a mouthpiece for a wind instrument and the space defining the plenum is sized to be larger than a tip end of the mouthpiece.

* * * * *